US011142882B2

(12) United States Patent
Takebayashi et al.

(10) Patent No.: US 11,142,882 B2
(45) Date of Patent: Oct. 12, 2021

(54) SMALL HYDRAULIC EXCAVATOR

(71) Applicant: Hitachi Construction Machinery Tierra Co., Ltd., Koka (JP)

(72) Inventors: Yoshifumi Takebayashi, Shiga (JP); Hajime Yoshida, Shiga (JP); Kazushige Mori, Shiga (JP); Natsuki Nakamura, Shiga (JP); Taihei Maehara, Shiga (JP)

(73) Assignee: Hitachi Construction Machinery Tierra Co., Ltd, Koka (JP)

( * ) Notice: Subject to any disclaimer, the term of this patent is extended or adjusted under 35 U.S.C. 154(b) by 593 days.

(21) Appl. No.: 16/080,387

(22) PCT Filed: Feb. 22, 2017

(86) PCT No.: PCT/JP2017/006681
§ 371 (c)(1),
(2) Date: Aug. 28, 2018

(87) PCT Pub. No.: WO2017/183287
PCT Pub. Date: Oct. 26, 2017

(65) Prior Publication Data

US 2020/0165794 A1 May 28, 2020

(30) Foreign Application Priority Data

Apr. 20, 2016 (JP) ..... JP2016-084774

(51) Int. Cl.
*E02F 3/32* (2006.01)
*E02F 9/22* (2006.01)
(Continued)

(52) U.S. Cl.
CPC ..... *E02F 3/325* (2013.01); *E02F 9/0866* (2013.01); *E02F 9/0875* (2013.01); *E02F 9/121* (2013.01);
(Continued)

(58) Field of Classification Search
CPC .... B60K 1/04; B60K 6/12; B60K 2001/0416; B60K 2006/123; B60K 2006/126;
(Continued)

(56) References Cited

U.S. PATENT DOCUMENTS 2,966,752 A * 1/1961 Wampach ..... B66C 23/86 37/395
3,217,825 A * 11/1965 Hauxwell ..... B60K 1/04 180/68.5
(Continued)

FOREIGN PATENT DOCUMENTS

CN 1840786 A 10/2006
CN 103703190 A 4/2014
(Continued)

OTHER PUBLICATIONS

International Search Report (PCT/ISA/210) issued in PCT Application No. PCT/JP2017/006681 dated May 30, 2017 with English translation (four (4) pages).
(Continued)

*Primary Examiner* — Edwin J Toledo-Duran
(74) *Attorney, Agent, or Firm* — Crowell & Moring LLP

(57) ABSTRACT

To provide a small hydraulic excavator, which even may have an upperstructure formed such that at least its rear end swings within a body width range and having a limited installation space for devices, that allows an accumulator to be disposed and allows the accumulator to be protected from external force generated during work. The present invention relates to a rear small-swing type mini excavator that includes an accumulator 30 accommodating and recovering potential energy and hydraulic energy used by at least one of drives of an undercarriage 1, an upperstructure 2 formed such that its rear end swings within the body width range of the undercarriage 1, and a working device 3. In the rear small-swing type mini excavator, the accumulator 30 is
(Continued)

disposed between a valve block 26 and a front longitudinal board 41 of a longitudinal board member included in a main frame 10 along the front longitudinal board 41, and a pipe connected to the accumulator 30 and the valve block 26 is disposed closer to the accumulator 30 and the valve block 26.

4 Claims, 5 Drawing Sheets

(51) Int. Cl.
*E02F 9/12* (2006.01)
*E02F 9/08* (2006.01)
*E02F 9/16* (2006.01)
*E02F 9/18* (2006.01)
*E02F 3/96* (2006.01)

(52) U.S. Cl.
CPC ..... *E02F 9/16* (2013.01); *E02F 9/18* (2013.01); *E02F 9/2217* (2013.01); *E02F 9/2267* (2013.01); *E02F 9/2275* (2013.01); *E02F 3/964* (2013.01)

(58) Field of Classification Search
CPC ..... B60W 2300/17; B60Y 2200/412; B62D 49/085; B66F 9/07554; B66F 9/24; B66F 9/07518; E02F 3/325; E02F 9/0858; E02F 9/0866; E02F 9/0875; E02F 9/0883; E02F 9/18; E02F 9/2217; E02F 9/121; E02F 9/16; E02F 9/2267; E02F 9/2275; E02F 3/964
USPC ..... 180/165, 312; 220/562; 280/834, 835
See application file for complete search history.

(56) References Cited

U.S. PATENT DOCUMENTS 3,367,441 A * 2/1968 Frankc ..... B62D 49/085 180/68.5
3,497,090 A * 2/1970 Daniels ..... B62D 37/04 414/347
4,149,733 A * 4/1979 Grooss ..... B60K 15/00 280/834
4,397,365 A * 8/1983 Harbe ..... B60L 50/66 180/68.5
4,761,954 A * 8/1988 Rosman ..... B66F 9/22 60/372
6,009,643 A 1/2000 Maeba et al.
6,170,180 B1 * 1/2001 Schaeff ..... E02F 3/325 220/4.14
6,199,307 B1 * 3/2001 Kagoshima ..... E02F 3/325 37/443
6,244,369 B1 * 6/2001 Yunoue ..... E02F 9/163 180/89.12
6,820,877 B1 11/2004 Ichimura et al.
6,901,729 B1 * 6/2005 Otto ..... A01D 41/145 56/208
6,918,247 B1 * 7/2005 Warner ..... E02F 9/2217 60/414
7,388,301 B2 * 6/2008 Komiyama ..... E02F 9/0866 180/312
7,849,951 B2 * 12/2010 Borchers ..... B66F 9/07586 180/305
8,100,210 B2 * 1/2012 Takeuchi ..... H01M 10/052 180/68.5
8,381,856 B2 * 2/2013 Shimomura ..... E02F 9/0858 180/68.5
8,540,042 B2 * 9/2013 Atarashi ..... B60L 58/26 180/68.1
8,616,322 B2 * 12/2013 Shimomura ..... E02F 9/0858 180/291
8,631,890 B2 * 1/2014 Noguchi ..... E02F 9/0858 180/68.1
8,662,969 B2 * 3/2014 Shimomura ..... E02F 9/0858 454/141
10,590,626 B2 * 3/2020 Iwamoto ..... E02F 9/18
2001/0007292 A1 * 7/2001 Yabf ..... F01P 11/12 180/68.1
2004/0173979 A1 9/2004 Ichimura et al.
2006/0226680 A1 10/2006 Matsumoto et al.
2007/0062894 A1 * 3/2007 Kubusch ..... B66F 9/07518 211/85.18
2007/0072063 A1 * 3/2007 Imashige ..... B62D 25/10 429/96
2008/0265666 A1 * 10/2008 Livesay ..... B62D 55/30 305/149
2013/0141889 A1 * 6/2013 Tsuchiya ..... H01M 10/42 361/821
2013/0152565 A1 6/2013 Ma et al.
2013/0299255 A1 * 11/2013 Matsumura ..... E02F 9/207 180/65.1
2013/0313030 A1 * 11/2013 Matsumura ..... B60L 50/66 180/65.1
2014/0000973 A1 * 1/2014 O'Donnell ..... E02F 9/18 180/165
2014/0017054 A1 1/2014 Motozu et al.
2016/0222632 A1 8/2016 Kohzu et al.
2016/0273192 A1 9/2016 Kajita et al.

FOREIGN PATENT DOCUMENTS

EP 1 767 706 A2 3/2007
JP 64-6188 U 1/1989
JP 2000-229508 A 8/2000
JP JP 2005-119362 A 5/2005
JP 2013-124693 A 6/2013
JP 2013-199784 A 10/2013
JP 2015-501913 A 1/2015
JP 2015-59330 A 3/2015
JP 2015-90194 A 5/2015
KR 10-0485993 B1 5/2005
WO WO 2016/108271 A1 7/2016

OTHER PUBLICATIONS

Japanese-language Written Opinion (PCT/ISA/237) issued in PCT Application No. PCT/JP2017/006681 dated May 30, 2017 (four (4) pages).

* cited by examiner

SMALL HYDRAULIC EXCAVATOR

TECHNICAL FIELD

The present invention relates to a small hydraulic excavator equipped with an accumulator that accumulates potential energy and hydraulic energy and recovers the energies.

BACKGROUND ART

Patent literatures 1 and 2 describe a technique of reducing energy consumption by regenerating potential energy and hydraulic energy generated by an inertial load in a hydraulic driving circuit and utilizing the potential energy and the hydraulic energy. Patent literatures 1 and 2 further describe one or a plurality of accumulators that accumulate potential energy and hydraulic energy and recover the energies.

Patent literature 3 describes a technique relating to arrangement of accumulators. Patent literature 3 describes a mid-size hydraulic excavator that arranges accumulators inside the counterweight.

CITATION LIST

Patent Literature

PATENT LITERATURE 1: JP-T No. 2015-501913
PATENT LITERATURE 2: JP-A No. 2015-90194
PATENT LITERATURE 3: JP-A No. 2015-59330

SUMMARY OF INVENTION

Technical Problem

Even a small hydraulic excavator, such as a rear small-swing type mini excavator with an upperstructure having its rear end swing within a body width range of the undercarriage and a micro-swing type mini excavator, needs to be equipped with an accumulator for a further reduction in energy consumption. A small hydraulic excavator such as the above-described mini excavators, however, is configured such that the rear end of the upperstructure swings within the body width range, and the upperstructure is therefore compactly constructed. An operator seat covered by a canopy is disposed on the upperstructure of the mini excavator. An operating device for operating the undercarriage is disposed in front of the operator seat. Operating devices for operating various actuators that actuate the upperstructure and a working device are disposed at both sides of the operator seat. Furthermore, a floor seat that forms a seating unit of the operator seat is provided on the upperstructure in a manner extending backward from a lower position in front of the operator seat and standing in the middle. An engine room accommodating an engine and a hydraulic pump is provided underneath the seating unit of the operator seat on the upperstructure. A laterally arcuately extending convexly curved counterweight is provided on the rear end side of the upperstructure in a manner covering the rear portion of the engine room. Furthermore, various devices such as a fuel tank, a hydraulic oil tank, and a control valve are disposed on the upperstructure. When disposing devices including an engine on the upperstructure, only a small space is therefore allowed for the devices because of the compact size of the upperstructure as described above.

Patent literature 3 describes a mid-size hydraulic excavator having a large counterweight, and this conventional technique allows accumulators to be disposed inside the counterweight. Disposing an accumulator inside the counterweight of a small hydraulic excavator such as the above-described mini excavator, however, needs an increase in the size of the counterweight to secure a determined weight of the counterweight. A small hydraulic excavator such as a mini excavator generally needs to be compactly constructed considering use, for example, on a narrow pathway, and the technique of Patent literature 3 is therefore inapplicable to the counterweight of such a small hydraulic excavator. Furthermore, an accumulator needs to be installed considering that the accumulator may take a large impact during work such as excavation work. A small hydraulic excavator such as a mini excavator therefore needs to arrange an accumulator in consideration of protection from external force.

To overcome the above-described problems, the present invention aims to provide a small hydraulic excavator, which even may include an upperstructure configured to have at least its rear end swing within the body width range and having a limited installation space for devices, that allows an accumulator to be disposed and further allows the accumulator to be protected from external force generated during work.

Solution to Problem

To overcome the above-described problems, a small hydraulic excavator according to the present invention includes an undercarriage, an upperstructure that is disposed on the undercarriage and is formed such that a rear end is swingable within a body width range of the undercarriage, a main frame of the upperstructure that has a pair of longitudinal board members juxtaposed along a longitudinal direction of the upperstructure, a working device that is vertically rotatably supported in front of a center of swing of the upperstructure and includes a boom and a boom cylinder, a counterweight that is disposed on a rear end side of the upperstructure, a valve block that is disposed on a side of the pair of longitudinal board members of the main frame and includes at least a plurality of directional control valves, and an accumulator that accommodates and recovers potential energy and hydraulic energy used by at least one of drives of the undercarriage, the upperstructure, and the working device. In the small hydraulic excavator, a frame continuous with a floor seat provided on the upperstructure and having an operator seat and the counterweight serve as partition walls that form an engine room. The accumulator is disposed between the valve block and the longitudinal board member of the main frame along the longitudinal board member. A pipe connected to the accumulator and the valve block is disposed closer to the accumulator and the valve block.

Advantageous Effects of Invention

A small hydraulic excavator according to the present invention has an accumulator disposed along a longitudinal board member included in the main frame. This configuration allows the accumulator to be disposed even on an upperstructure that is configured to have its rear end swing within the body width range and has a limited installation space for devices. Furthermore, the accumulator is disposed between the longitudinal board member of the main frame as a strengthening member and a valve block, which can protect the accumulator from external force generated during work such as excavation work. As another advantageous effect, a pipe connected to the accumulator and the valve block is disposed closer to the accumulator and the valve blocks, which allows the pipe to be formed shorter.

BRIEF DESCRIPTION OF DRAWINGS

FIG. 4A is a side view.

DESCRIPTION OF EMBODIMENTS

Embodiments of a small hydraulic excavator according to the present invention will now be described with reference to the drawings.

Figure 1:
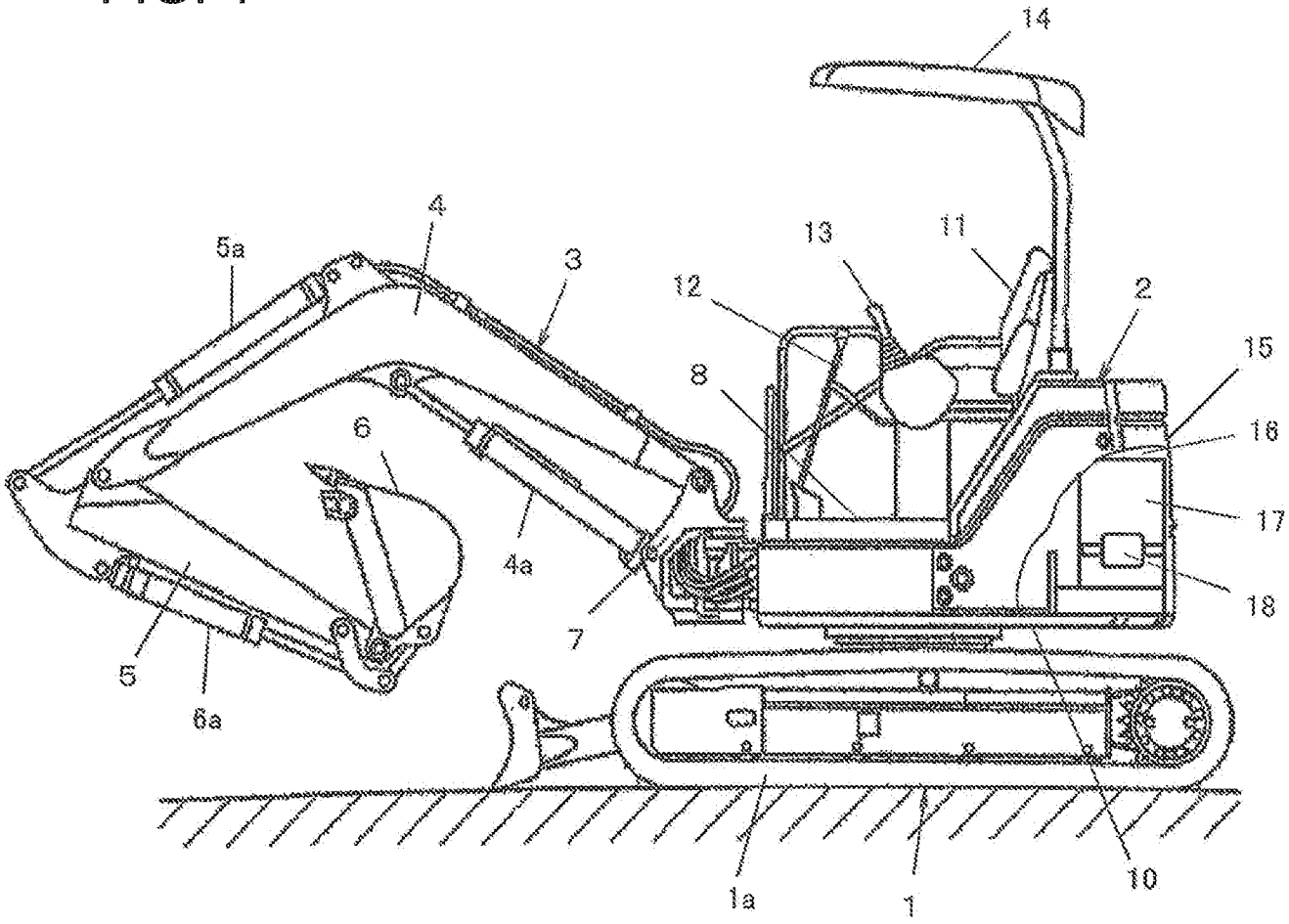
FIG. 1 is a side view of a mini excavator constituting a first embodiment of a small hydraulic excavator according to the present invention.
Figure 2:
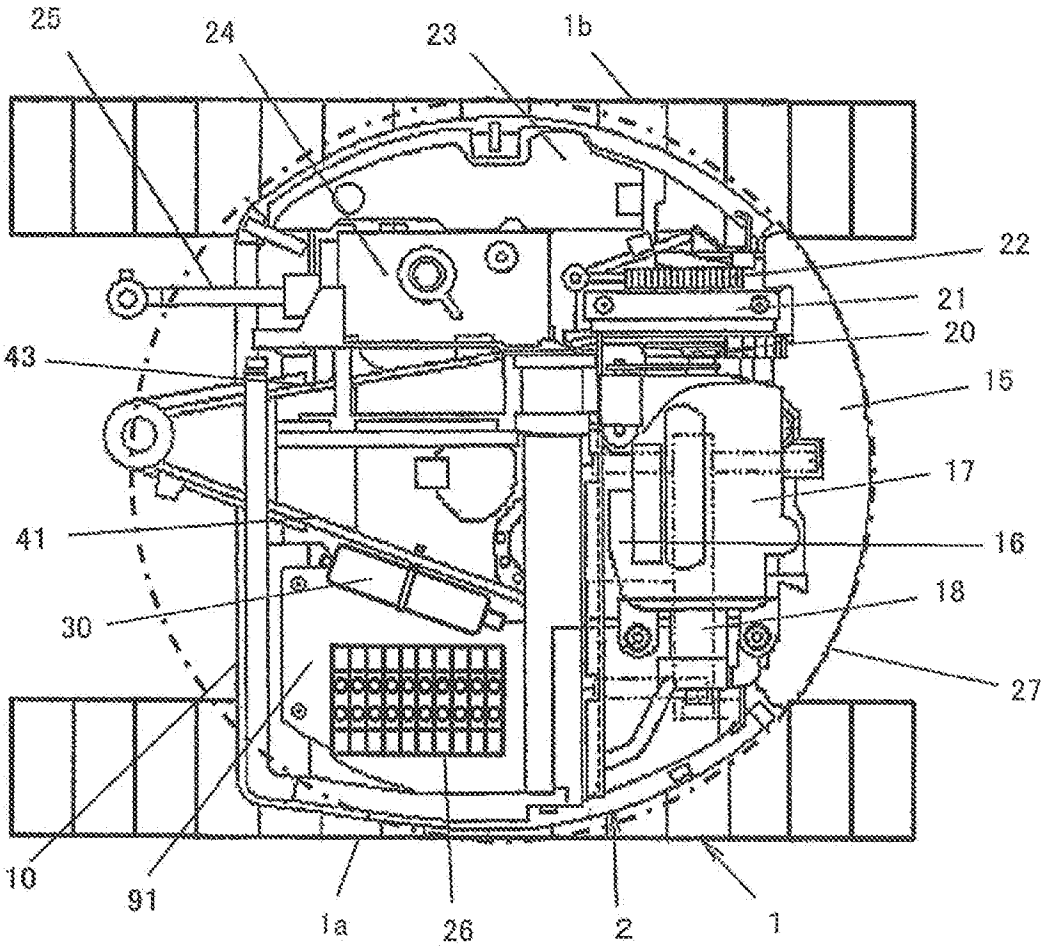
FIG. 2 is a flat view illustrating arrangement of devices mounted on a main frame of the mini excavator according to the first embodiment.

As illustrated in FIG. 1 and FIG. 2, the first embodiment of a small hydraulic excavator of the present invention is constituted as, for example, a rear small-swing type mini excavator. The first embodiment includes an undercarriage 1 having a pair of tracks 1*a* and 1*b* and an upperstructure 2 mounted on the undercarriage 1. The first embodiment further includes a working device 3 for performing work such as excavation of earth and sand.

The working device 3 is coupled to a swing post 7 disposed on a front end side of the upperstructure 2, situated at a front position with respect to the center of swing of the upperstructure 2, and supported in a laterally swingable and vertically rotatable manner.

The working device 3 includes a boom 4 coupled to the swing post 7, an arm 5 coupled to the distal end of the boom 4, a bucket 6 coupled to the distal end of the arm 5, and a plurality of hydraulic actuators including a boom cylinder 4*a* vertically rotating the boom 4, an arm cylinder 5*a* vertically rotating the arm 5, and a bucket cylinder 6*a* vertically rotating the bucket 6.

An operator seat 11 is disposed on a main frame 10 of the upperstructure 2. A floor seat 8 forming a seating unit of the operator seat 11 is provided in a manner extending backward from a position for placing the operator's feet in front of the operator seat 11 and standing in the middle. A pair of operating devices 12 for operating the undercarriage 1 are disposed in front of the operator seat 11, and a pair of operating devices 13 for operating the upperstructure 2 and the working device 3 are disposed at the right and left positions of the operator seat 11. A canopy 14 covering the operator seat 11 from above is further provided.

A counterweight 15 is disposed on a rear end side on the main frame 10 of the upperstructure 2. An engine room 16 is formed underneath the seating unit of the operator seat 11 on the floor seat 8, on the inner side of the counterweight 15. A frame continuous with the floor seat 8 having the operator seat 11 and the counterweight 15 serve as partition walls that foam the engine room 16. The engine room 16 accommodates therein a hydraulic pump 18 for supplying pressure oil to a plurality of hydraulic actuators such as the earlier-described hydraulic actuator included in the working device 3, a travel motor for driving the undercarriage 1, and a swing motor for driving the upperstructure 2 and an engine 17 for driving the hydraulic pump 18.

As illustrated in FIG. 2, the engine 17 is transversely mounted. In the engine room 16, a cooling fan 20 starting in response to drive of the engine 17, a radiator 21 and an oil cooler 22 cooled by the wind generated by the cooling fan 20 are disposed at the right-side side part of the engine 17. A fuel tank 23 and a hydraulic oil tank 24 are disposed in front of the radiator 21 and the oil cooler 22 in the engine room 16. A swing cylinder 25 for swinging the boom 4 of the working device 3 is disposed underneath the hydraulic oil tank 24.

Furthermore, a valve block 26 at least including a plurality of directional control valves for controlling a flow of the pressure oil supplied from the hydraulic pump 18 to the hydraulic actuators and an accumulator 30 that accumulates and recovers potential energy and hydraulic energy used by at least one of hydraulic driving systems of the undercarriage 1, the upperstructure 2, and the working device 3 are disposed in front of the engine room 16, on the main frame 10 on a front underneath side of the earlier-described floor seat 8. The installation modes of the accumulator 30 will be described later.

As further illustrated in FIG. 2, the counterweight 15 is disposed in a manner covering a rear surface on the rear end side of the engine room 16 and is formed in a laterally arcuately extending convexly curved shape. This rear small-swing type mini excavator according to the first embodiment is configured such that the upperstructure 2 swings with a rear-end surface portion of the upperstructure 2 including the counterweight 15 fit within the body width range of the undercarriage 1 as indicated by a dotted chain line 27.

Figure 3:
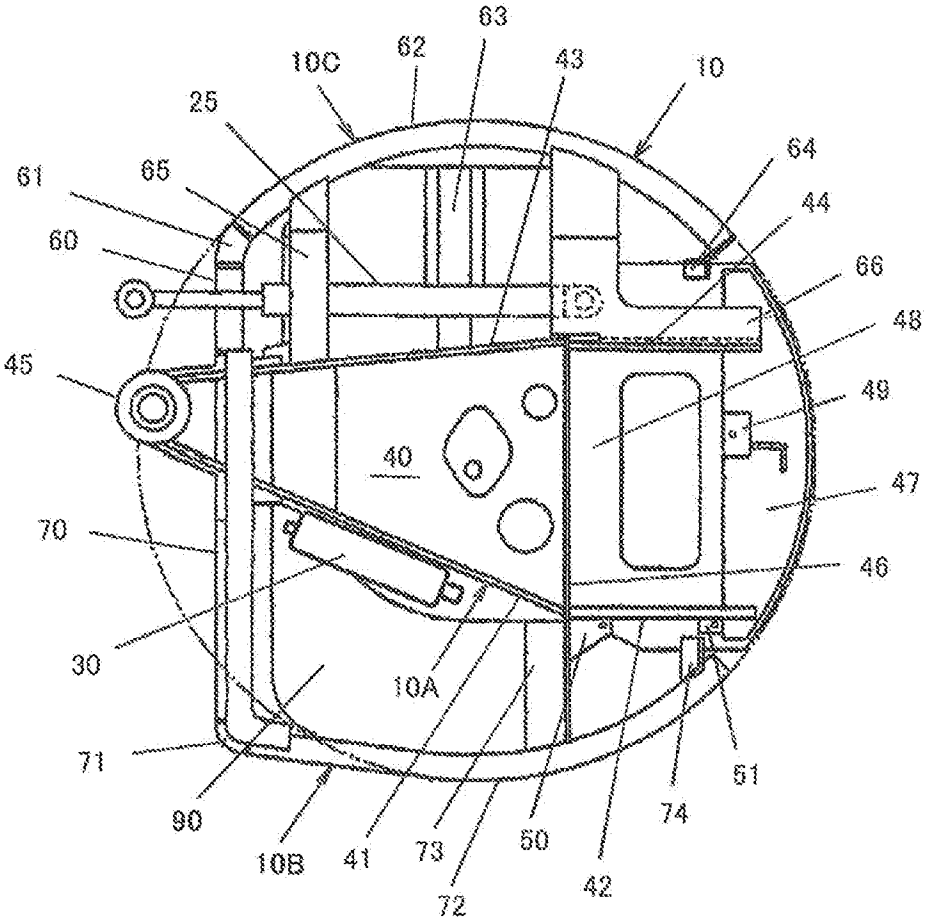
FIG. 3 is a flat view illustrating a configuration of the main frame included in the first embodiment.

As illustrated in FIG. 3, the main frame 10 of the upperstructure 2 is constituted by a center frame 10A, a left side frame 10B disposed at the left side of the center frame 10A, and a right side frame 10C disposed at the right side of the center frame 10A.

The center frame 10A has a bottom board 40, a left front longitudinal board 41 and a left rear longitudinal board 42 forming one side of a pair of longitudinal board members arranged upright on the bottom board 40 and juxtaposed along the longitudinal direction of the upperstructure 2, and a right front longitudinal board 43 and a right rear longitudinal board 44 forming the other side of the pair of longitudinal board members. The center frame 10A further has a swing bracket 45 joined to the front ends of the bottom board 40 and the front longitudinal boards 41 and 43 and accommodating the earlier-described swing post 7 in a horizontally rotatable manner.

The center frame 10A further has a transverse board 46 arranged upright on the bottom board 40, joined between the rear ends of the front longitudinal boards 41 and 43 and the front ends of the rear longitudinal boards 42 and 44, and laterally extending. An engine supporting unit 48 and a supporting bracket 49 are provided between the rear longitudinal boards 42 and 44 in a manner separated from each other in the longitudinal direction. Supporting brackets 50 and 51 are provided at the left side of the left rear longitudinal board 42 in a manner separated from each other in the longitudinal direction. The engine 17 is mounted on the engine supporting unit 48 and assembled by using the supporting brackets 49, 50, and 51.

The right side frame 10C is formed of, for example, a pipe member having a D-shape sectional surface and has a straight front frame 60 joined to the right side of the swing bracket 45 and laterally extending and an arcuately curved frame 62 coupled to an end portion of the front frame 60 through a joint 61. The curved frame 62 has its middle portion coupled to the bottom board 40 through a suspension beam 63 and has its rear end portion coupled to the bottom board 40 through a coupling bracket 64.

Between the curved frame 62 and the right front longitudinal board 43, an attachment board 65 is joined in front of the suspension beam 63, and an attachment board 66 is joined behind the suspension beam 63. The attachment boards 65 and 66 are provided in consideration of allocation of a space for the swing cylinder 25 and installation of the fuel tank 23, the hydraulic oil tank 24, the radiator 21, and the oil cooler 22.

As with the right side frame 10C, the left side frame 10B is formed of, for example, a pipe member having a D-shape sectional surface and has a straight front frame 70 joined to the left side of the swing bracket 45 and laterally extending and an arcuately curved frame 72 coupled to an end portion of the front frame 70 through a joint 71. The curved frame 72 has its middle portion coupled to the bottom board 40 through a suspension beam 73 and the transverse board 46 and has its rear end portion coupled to the bottom board 40 through a coupling bracket 74.

A board member 91 illustrated in FIG. 2 is attached in a manner closing a space portion 90 illustrated in FIG. 3 formed in a manner surrounded by the front frame 70 and the curved frame 72 of the left side frame 10B and the front longitudinal board 41 of the center frame 10A, and the valve block 26 including at least a plurality of directional control valves is mounted on the board member 91.

As illustrated in FIG. 2 and FIG. 3, the accumulator 30 is disposed on the main frame 10 between the valve block 26 and the left front longitudinal board 41 of the center frame 10A along the front longitudinal board 41. A pipe (not illustrated) connected to the accumulator 30 and the valve block 26 is disposed closer to the accumulator 30 and the valve block 26.

Figure 4A:
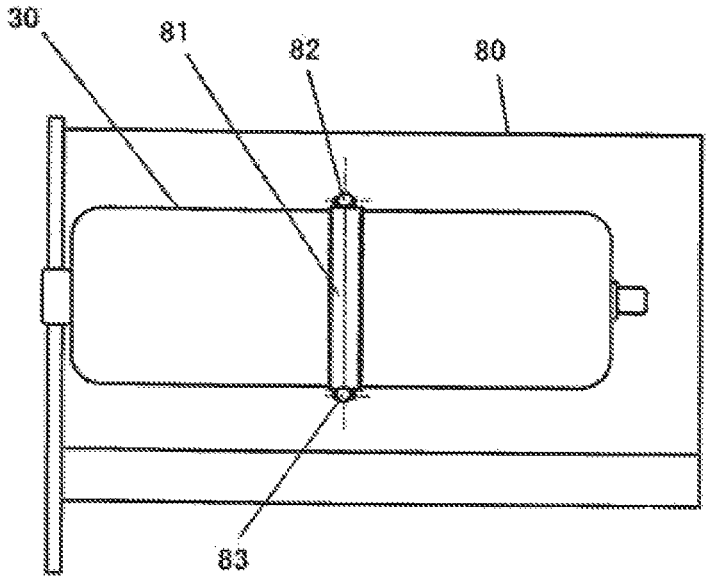
FIGS. 4A,B are drawings of a retention unit of an accumulator included in the first embodiment.
Figure 4B:
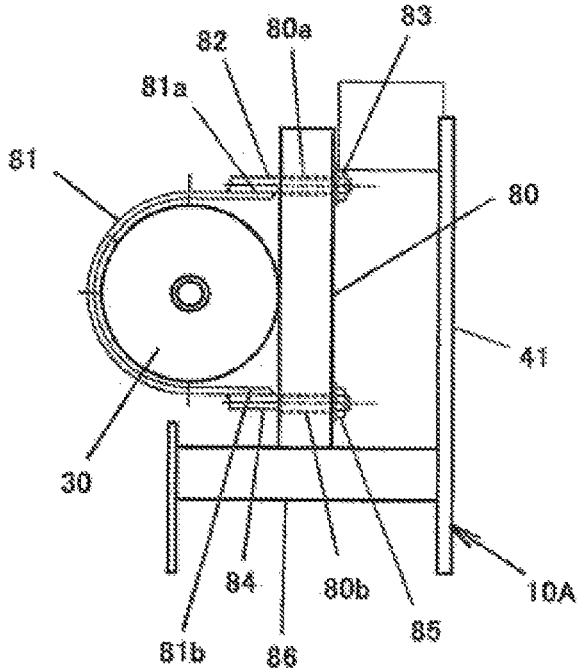
FIG. 4B is a front view.

The first embodiment includes a retention unit installed to the main frame 10 and retaining the accumulator 30. This retention unit includes, as illustrated in FIGS. 4A and 4B, a base board 86 joined to a side surface of the left front longitudinal board 41 of the center frame 10A and horizontally extending, a retention board 80 fixed upright to the base board 86 in a manner facing the side surface of the front longitudinal board 41, and a fastening unit fastening the accumulator 30 to the retention board 80.

The fastening unit includes a band 81 formed of a band plate half wound around the peripheral surface of the accumulator 30, an upper screw rod 82 threaded to a screw portion 80*a* famed at an upper position of the retention board 80 and welded to an end 81*a* of the band 81 and an upper nut 83 threaded onto the upper screw rod 82. The fastening unit further includes a lower screw rod 84 threaded to a screw portion 80*b* formed at a lower position of the retention board 80 and welded to another end 81*b* of the band 81 and a lower nut 85 threaded onto the lower screw rod 84. The accumulator 30 is fixed in a manner sandwiched between the retention board 80 and the band 81 by tightening the upper nut 83 and the lower nut 85.

As described above, the rear small-swing type mini excavator according to the first embodiment has the accumulator 30 disposed along the left front longitudinal board 41 included in the main frame 10. Even with the upperstructure 2 having a limited installation space for devices and configured to have at least its rear end swing within the body width range of the undercarriage 1, this configuration allows the accumulator 30 to be disposed using a space formed between the front longitudinal board 41 and the valve block 26 on the upperstructure 2. The front longitudinal board 41 of the center frame 10A as a strengthening member supports the accumulator 30 inside the upperstructure 2, which can protect the accumulator 30 from external force generated during work such as excavation work. Furthermore, a pipe connected to the accumulator 30 and the valve block 26 is disposed closer to the accumulator 30 and the valve block 26, which allows the pipe to be formed shorter.

Figure 5:
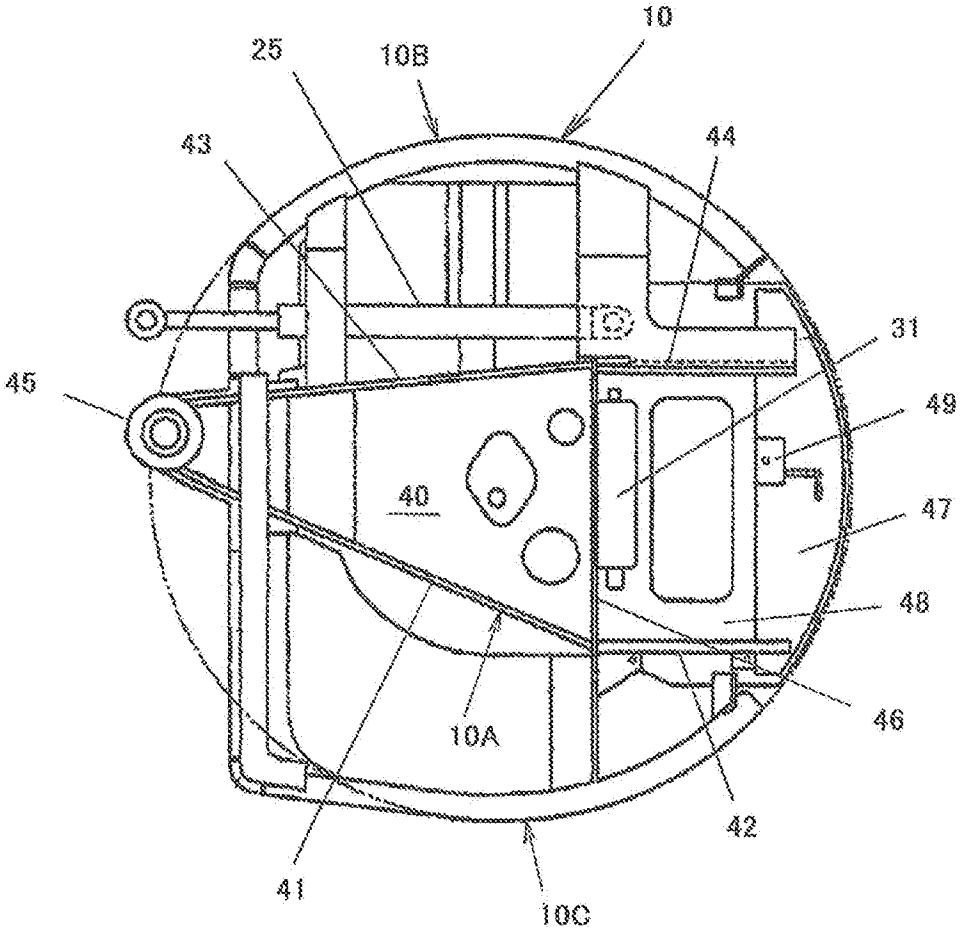
FIG. 5 is a flat view of a main frame constituting an essential part of a second embodiment of the present invention.

FIG. 5 is a flat view of a center frame constituting an essential part of a second embodiment of the present invention. In the second embodiment, in addition to the configuration of the above-described first embodiment, an accumulator 31 different from the above-described accumulator 30 is disposed along the transverse board 46 connected between a longitudinal board member forming one side of a pair of longitudinal board members included in the main frame 10 of the upperstructure 2 and including the front longitudinal board 41 and the rear longitudinal board 42 and a longitudinal board member forming the other side of the pair of longitudinal board members and including the front longitudinal board 43 and the rear longitudinal board 44. In other words, the accumulator 31 is disposed between a side surface of the transverse board 46 of the center frame 10A and the engine 17 mounted on the main frame 10. Other than this, the second embodiment has the same configuration as that of the first embodiment, and a small hydraulic excavator according to the second embodiment is constituted as, for example, a rear small-swing type mini excavator.

In the second embodiment having the above-described configuration, the different accumulator 31 is disposed between the transverse board 46 constituting the center frame 10A and the engine 17 on the main frame 10 along the transverse board 46. This configuration allows the different accumulator 31 to be disposed on the upperstructure 2, which even may have a limited installation space for devices. Furthermore, the transverse board 46 of the center frame 10A as a strengthening member can protect the accumulator 31 inside the upperstructure 2 from external force generated during work such as excavation work.

The first embodiment includes one accumulator 30; however, in the case with a further limited installation space on the main frame 10, a plurality of accumulators smaller than the accumulator 30 may be disposed between the front longitudinal board 41 and the valve block 26 on the main frame 10 along the front longitudinal board 41.

In the second embodiment, the accumulator 31 is disposed closer to a side surface on the engine 17 side of the transverse board 46 of the center frame 10A. Instead of this arrangement, the accumulator 31 may be disposed closer to a side surface opposite to the side with the engine 17 of the transverse board 46.

The first embodiment and the second embodiment describe a rear small-swing type mini excavator as an example of the small hydraulic excavator; however, the present invention is not limited to the rear small-swing type mini excavator. For example, the present invention may be applied to a micro-swing type mini excavator having no swing posts as the above-described rear small-swing type mini excavator and configured such that a working device including a boom and a boom cylinder is vertically rotatably supported by a pair of longitudinal boards of a main frame situated at a side of an operator seat on an upperstructure and that the radius of swing of the upperstructure fits within the body width range of the undercarriage.

REFERENCE SIGNS LIST

1 . . . Undercarriage
1*a* . . . Track
1*b* . . . Track
2 . . . Upperstructure
3 . . . Working device
4 . . . Boom
4*a* . . . Boom cylinder
5 . . . Arm
5*a* . . . Arm cylinder
6 . . . Bucket
6*a* . . . Bucket cylinder
7 . . . Swing post
8 . . . Floor seat
10 . . . Main frame
10A . . . Center frame
10B . . . Left side frame
10C . . . Right side frame
11 . . . Operator seat
14 . . . Canopy
15 . . . Counterweight
16 . . . Engine room
17 . . . Engine
18 . . . Hydraulic pump
26 . . . Valve block
27 . . . Dotted chain line
30 . . . Accumulator
31 . . . Accumulator
41 . . . Front longitudinal board (longitudinal board member)
45 . . . Swing bracket
46 . . . Transverse board
80 . . . Retention board
80*a* . . . Screw portion
81 . . . Band
81*a* . . . End
81*b* . . . Another end
82 . . . Upper screw rod
83 . . . Upper nut
84 . . . Lower screw rod
85 . . . Lower nut
86 . . . Base board
90 . . . Space portion
91 . . . Board member

The invention claimed is:

1. A small hydraulic excavator comprising: an undercarriage; an upperstructure that is swingably disposed on the undercarriage and is configured such that a rear end of the upperstructure is within a body width range of the undercarriage while the upperstructure swings; a main frame of the upperstructure that has a pair of longitudinal board members juxtaposed along a longitudinal direction of the upperstructure; a working device that is vertically rotatably supported in front of a center of swing of the upperstructure and includes a boom and a boom cylinder; a counterweight that is disposed on a rear end side of the upperstructure; a valve block that is disposed on a one side of the pair of longitudinal board members of the main frame and includes at least a plurality of directional control valves; and an accumulator that accommodates and recovers potential energy and hydraulic energy used by at least one of drives of the undercarriage, the upperstructure, and the working device, the small hydraulic excavator in which a frame continuous with a floor seat provided on the upperstructure and having an operator seat and the counterweight serve as a partition wall that forms an engine room, wherein the accumulator is disposed between the valve block and the one side of the pair of the longitudinal board members of the main frame along the one side of the pair of the longitudinal board members, and a pipe connected to the accumulator and the valve block is disposed closer to the accumulator and the valve block.

2. The small hydraulic excavator according to claim 1, further comprising:

a retention unit that is installed to the main frame and retains the accumulator.

3. The small hydraulic excavator according to claim 1, wherein the accumulator and the valve block are disposed underneath the floor seat.

4. The small hydraulic excavator according to claim 1, wherein the main frame includes a transverse board disposed on a rear end side of the upperstructure and connected to the pair of longitudinal board members, and another accumulator different from the accumulator is disposed along the transverse board.

* * * * *